United States Patent [19]

Crosman

[11] 4,366,375

[45] Dec. 28, 1982

[54] THREE-COIN REGISTER TOY BANK

[75] Inventor: Dorland L. Crosman, Bloomfield, N.J.

[73] Assignee: Buddy L Corporation, New York, N.Y.

[21] Appl. No.: 216,250

[22] Filed: Dec. 15, 1980

[51] Int. Cl.[3] ..... G07G 1/00

[52] U.S. Cl. ..... 235/100; 235/1 E

[58] Field of Search ..... 235/1 E, 2, 32, 100

[56] References Cited

U.S. PATENT DOCUMENTS

| | | | |
|---|---|---|---|
| 1,901,030 | 3/1933 | Hoffman | 235/100 |
| 2,262,475 | 11/1941 | Stiriss | 235/100 |
| 2,590,271 | 3/1952 | Pudark et al. | 235/100 |

*Primary Examiner*—L. T. Hix
*Assistant Examiner*—Benjamin R. Fuller
*Attorney, Agent, or Firm*—Michael Ebert

[57] ABSTRACT

A coin register toy bank adapted to accept and totalize coins of different size. Each coin is deposited in the receiver of a rotary drum mounted above a coin box, the drum being operatively coupled by an intermediate clutch plate to a register wheel having a circular series of teeth on the side thereof facing the drum. The drum is manually turned by a pull-down lever from its normal coin-receiving angular position to an extreme position at which the receiver is aligned with the entry of the cash box into which the coin drops. As the drum turns, the register wheel is caused by the clutch plate which engages the teeth thereof to advance incrementally to an extent depending on the size of the received coin, thereby indicating the deposit. To prevent the advancing wheel from overshooting and misindicating the deposit, an interlock mechanism is provided which is triggered when the drum assumes its extreme position and then acts to detent one of the wheel teeth to prevent any further wheel advance.

9 Claims, 7 Drawing Figures

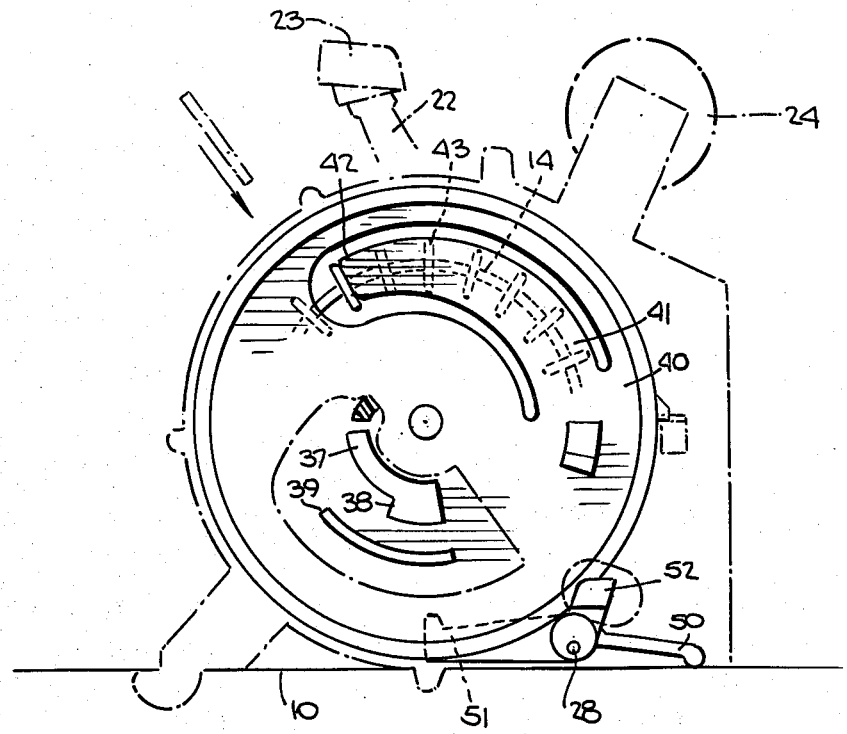
Fig. 5.
Fig. 6.
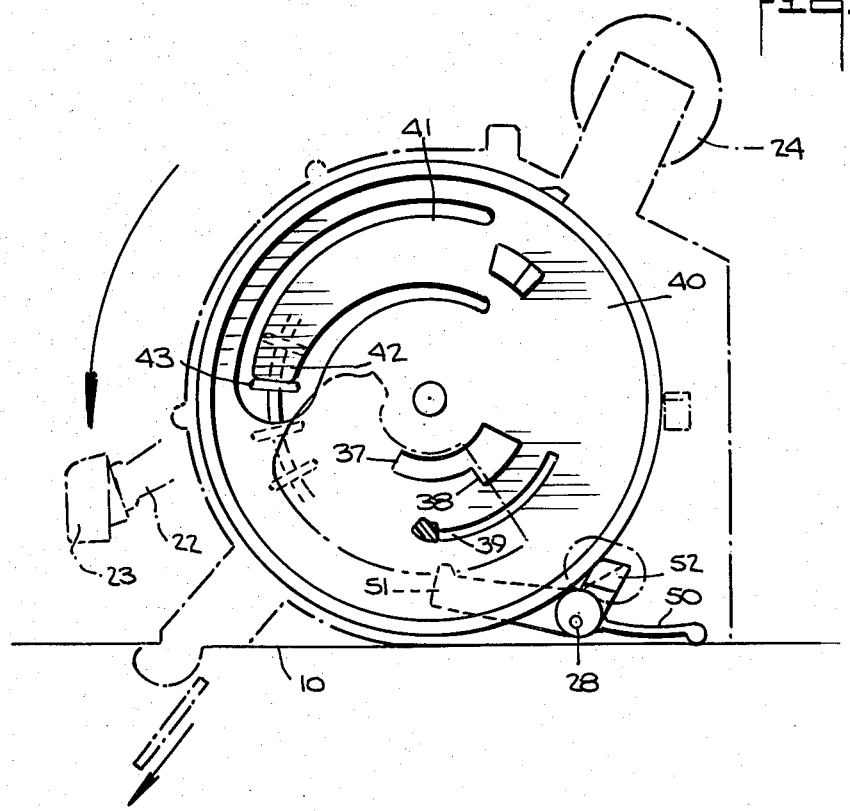

THREE-COIN REGISTER TOY BANK

BACKGROUND OF INVENTION

This invention relates generally to toy register banks, and more particularly to a three-coin bank which accepts and totals up nickeks, dimes and quarters.

Toy banks have a long history in the United States, for since early times they have been used to foster financial prudence in children. The continuing popularity of toy banks, apart from their useful teaching function, may be ascribed to their play value; for children enjoy dropping coins into the bank and ringing up the amount deposited. Then, of course, with toy banks, the diligent young saver is ultimately rewarded; for when a predetermined amount of coins has been deposited, as when the treasury in the coin box reaches $20, the locked door of the cash box is automatically released to make the accumulated coins available to the saver.

A coin register bank is distinguishable from a so-called piggy bank, which is simply a receptacle for coins, by the fact that when a coin is deposited, the value thereof is indicated by a register which acts to total up the deposited coins to provide a running account of the successive deposits.

The concern of the present invention is with the three-coin register banks adapted to accept nickels, dimes and quarters. A conventional bank of this type includes a lever-operated drum provided with a coin receiver, the arrangement being such that when a coin is deposited and the lever is then pulled down, the coin is caused to drop into the cash box, this action being accompanied by the ringing of a bell and registration of the amount deposited.

The drum is rotatably mounted on an axle above the cash box, the axle also supporting first and second register wheels. The first wheel has a peripheral scale graduated in 5-point increments to cover 100 points. The second wheel, assuming a bank having a 20-dollar capacity, has a scale graduated in steps of 1 to cover 20 points.

The drum is coupled by a clutch plate to a circular series of teeth on the side of the first wheel facing the plate such that when the drum is turned to deposit a received coin, the first wheel is caused to advance incrementally to an extent determined by the value of the coin. Thus starting with an empty bank, if the child deposits a nickel, when he pulls down the lever, the first wheel will shift from 00 to 05. If now he deposits a quarter, the first wheel will go from 05 to 30; and if he then drops in a dime, it will go from 30 to 40. The first wheel completes a full revolution when one dollar in coins has been received.

The second wheel is intermittently coupled to the first wheel so that the second wheel is caused to advance a single one-point step each time the first wheel makes a full turn. Thus if the first wheel makes three full turns, indicating that 3 dollars in coins have been received, for each of these turns the second wheel advances one step and displays the number 3 after the first wheel has made its third turn. When the second wheel reaches 20, which is the capacity of the bank, the second wheel then activates the cash box door lock release.

The problem to which the present invention is addressed is that of overshooting; for with a standard three-coin register bank, when the lever which operates the coin-receiving drum is pulled down hard and fast, the drum coupled by the clutch plate to the first register wheel may cause this wheel to overtravel. The reason for this is the momentum imparted to the first wheel by a fast-moving drum, the momentun causing this wheel to go beyond its intended point.

Thus when a quarter is deposited in the drum receiver and the lever is then pulled down very fast, this may cause the first wheel to register a 30-point rather than a 25-point increment. As a consequence, the register is rendered inaccurate and the bank fails to fulfil its intended purpose.

SUMMARY OF INVENTION

In view of the foregoing, the main object of this invention is to provide a three-coin register toy bank whose coin-receiving drum is operated by a lever, which bank has a register that always accurately represents the amount deposited regardless of how fast the drum lever thereof is pulled.

More particularly, an object of this invention is to provide in a three-coin register toy bank an interlock mechanism to prevent overshooting of the first register wheel even when the drum operatively coupled thereto imparts a high degree of momentum to this wheel.

Yet another object of the invention is to provide a three-coin register bank having an interlock mechanism which can be inexpensively mass-produced, whereby the cost of manufacturing a bank which incorporates this expedient is not substantially higher than the cost of making standard banks.

Briefly stated, these objects are attained in a toy bank adapted to accept coins of different size, the coins being deposited one at a time in the receiver of a rotary drum when the drum is at its normal angular position. The drum, which is mounted above a cash box, is turned by a pull-down lever to assume an extreme angular position at which the receiver is aligned with the entry of the box into which the coin drops.

The drum is operatively coupled by a clutch plate to a circular series of teeth formed on the side of an adjacent first register wheel which turns on the same axis as the drum. The clutch arrangement is such that as the drum turns in the pull-down direction, the wheel is caused to advance incrementally to an extent depending on the size of the received coin, thereby indicating the deposit.

To prevent the wheel from overshooting and misindicating the deposit, an interlock mechanism is provided having a nose that is normally retracted from the teeth of the first wheel, the mechanism being triggered only when the drum assumes its extreme position to project the nose and cause it to detent one of the teeth on the wheel and thereby prevent any further advance thereof. The first wheel is intermittently coupled to a second wheel whereby a full turn of the first wheel results in an incremental advance of the second wheel to indicate the deposit of a dollar's worth of coins.

OUTLINE OF DRAWINGS

For a better understanding of the invention as well as other objects and further features thereof, reference is made to the following detailed description to be read in conjunction with the accompanying drawings, wherein:

FIG. 5 is an end view showing the relationship between the clutch plate and the teeth on the first register wheel when the drum is in its normal angular position;

FIG. 6 is the same as FIG. 5, except that now the drum is in its extreme angular position.

DESCRIPTION OF INVENTION

Figure 2:
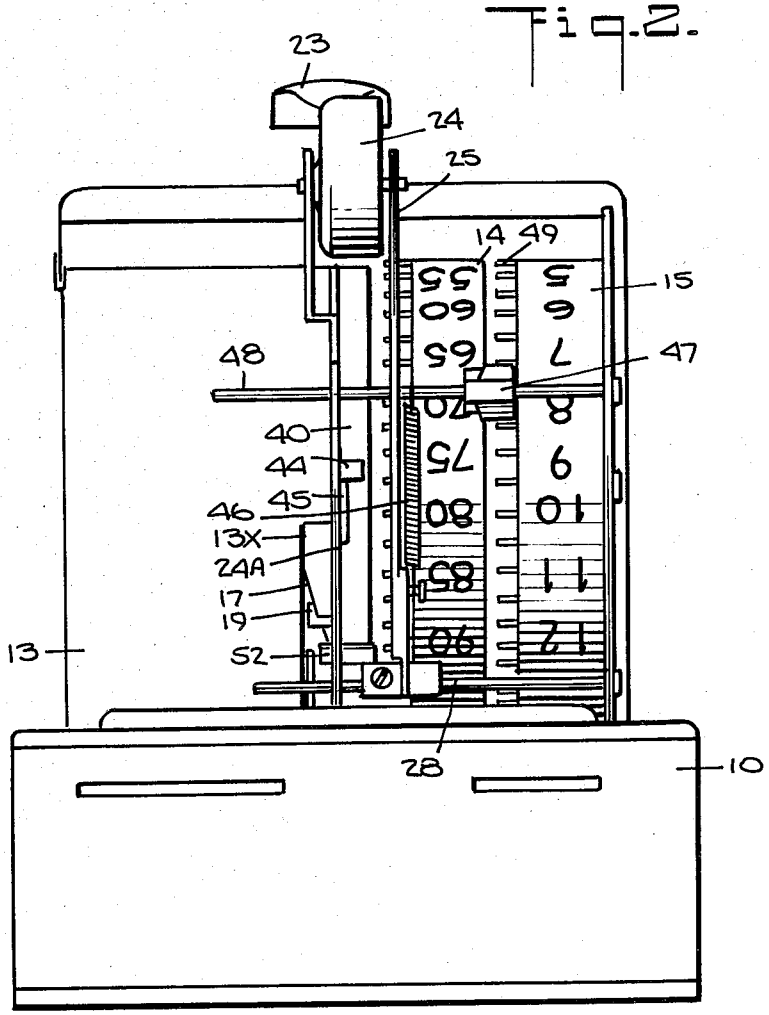
FIG. 2 is an elevation view of the toy bank as seen from the rear.
Figure 1:
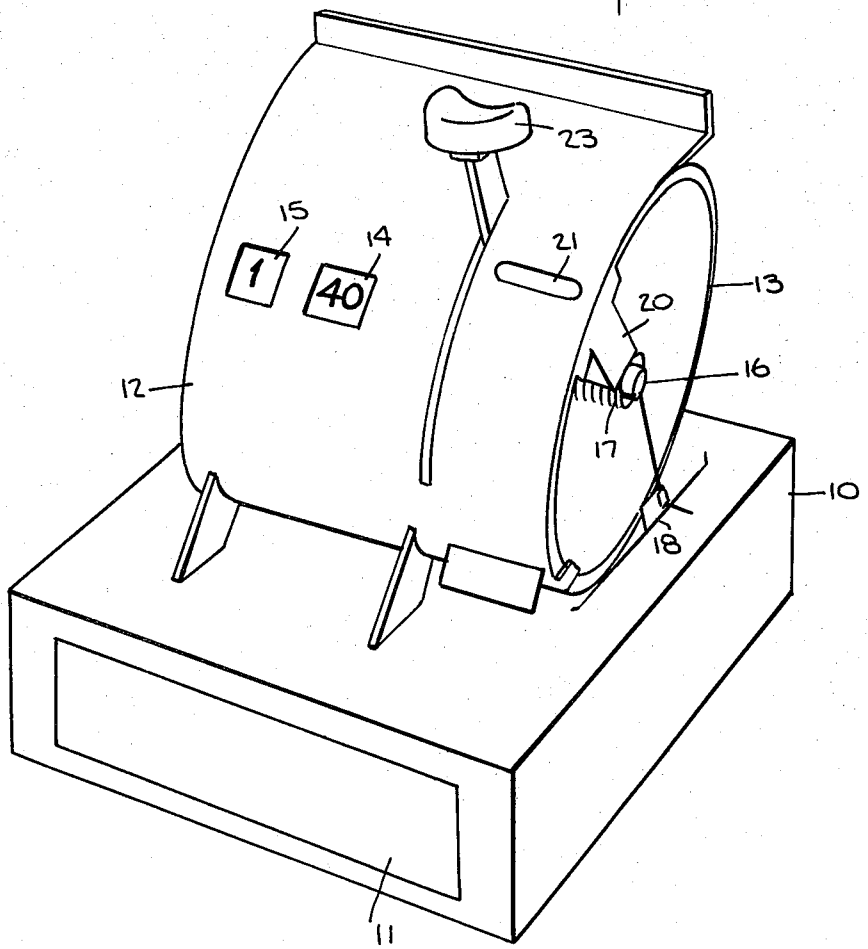
FIG. 1 is a perspective view of a three-coin register toy bank in accordance with the invention, as seen from the front with its case removed.

Referring now to FIGS. 1 and 2, a toy bank in accordance with the invention is shown with its outer case removed, the bank including a cash box 10 for collecting coins desposited in the box. The front door 11 of the cash box is normally locked so that the coins collected therein cannot be withdrawn until the door is unlatched.

Anchored on the top wall of cash box 10 is a sheet metal frame having a curved front shield section 12 which conforms to the curvature of a cylindrical hollow drum 13, a first register wheel 14, and a second register wheel 15. The drum and the register wheels have the same diameter and are rotatably mounted on a common axle 16 parallel to the top wall of box 10.

Wound about axle 16 within drum 13 is a helical spring 17, one end of which is fixed at point 18 on the frame, the other end (see FIG. 3) being held by a tab 19 onto the side wall of the drum. Spring 17 urges hollow drum 13 to occupy its normal angular position at which a coin receiver 20 mounted within the drum has its inlet mouth aligned with a slot 21 formed in shield 12. Thus at the normal drum position, a coin C inserted in slot 21 will fall into receiver 20; and when the drum is pulled down in the counterclockwise direction, the mouth of the receiver is blocked by shield 12 so that the coin is retained until at the extreme angular position of the drum, the receiver mouth is aligned with an entry port 10X on the top wall of the cash box, at which point the coin drops into the box.

Figure 7:
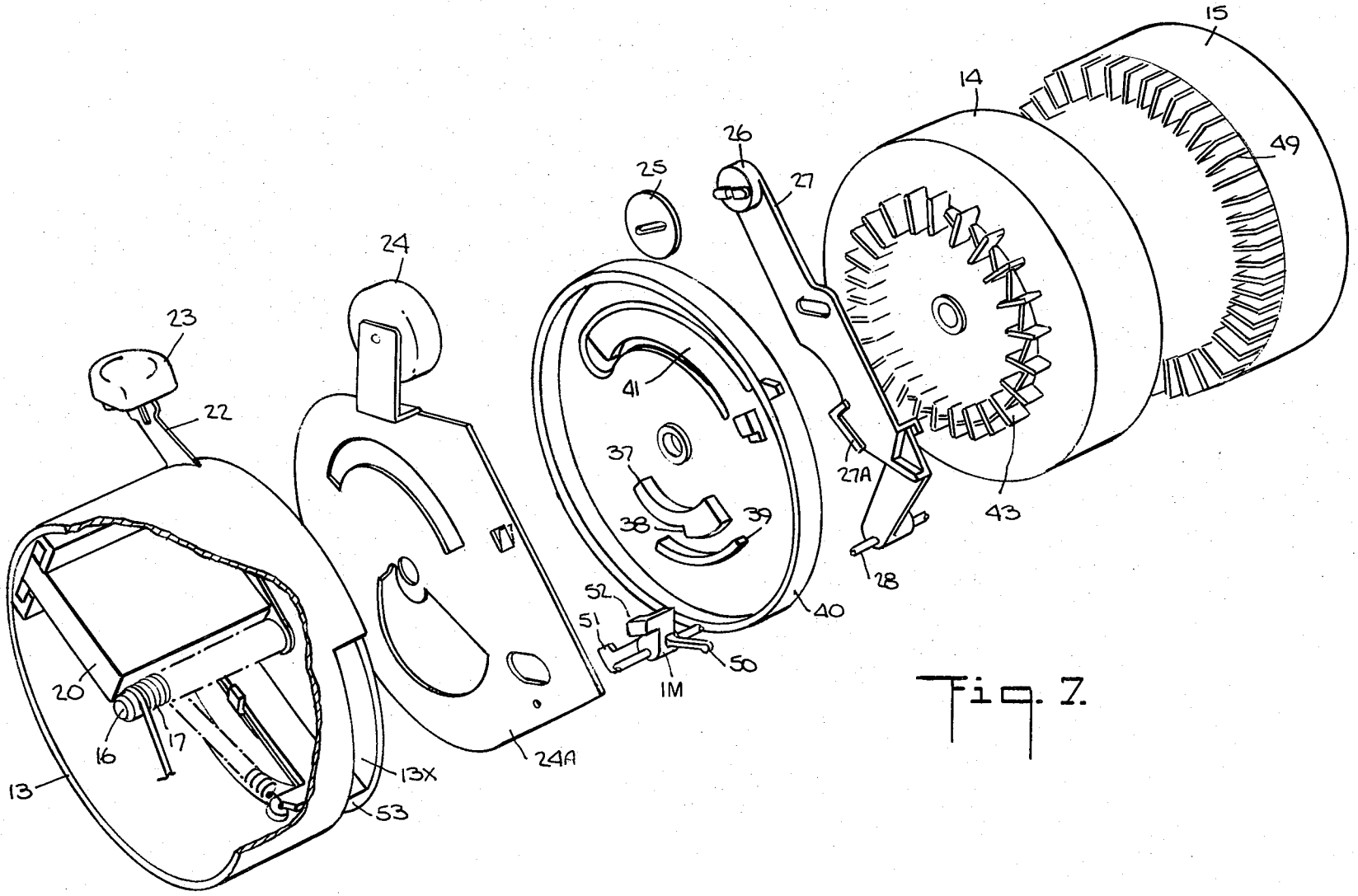
FIG. 7 is an exploded view of the toy bank components.

Drum 13 is turned by a manually-operated pull-down lever 22 whose lower end is pivoted on axle 16 and whose upper end has a handle 23 attached thereto. When the lever is released, the drum automatically returns in the clockwise direction to its normal angular position. As best seen in FIG. 7, the coin bank is also provided with a bell 24 mounted on a bell plate 24A and operated by a clapper in the form of a slotted disc 25 loosely attached to a ribbon button 26 at the free end of a clapper arm 27 whose lower end is pivoted on a shaft 28.

Figure 3:
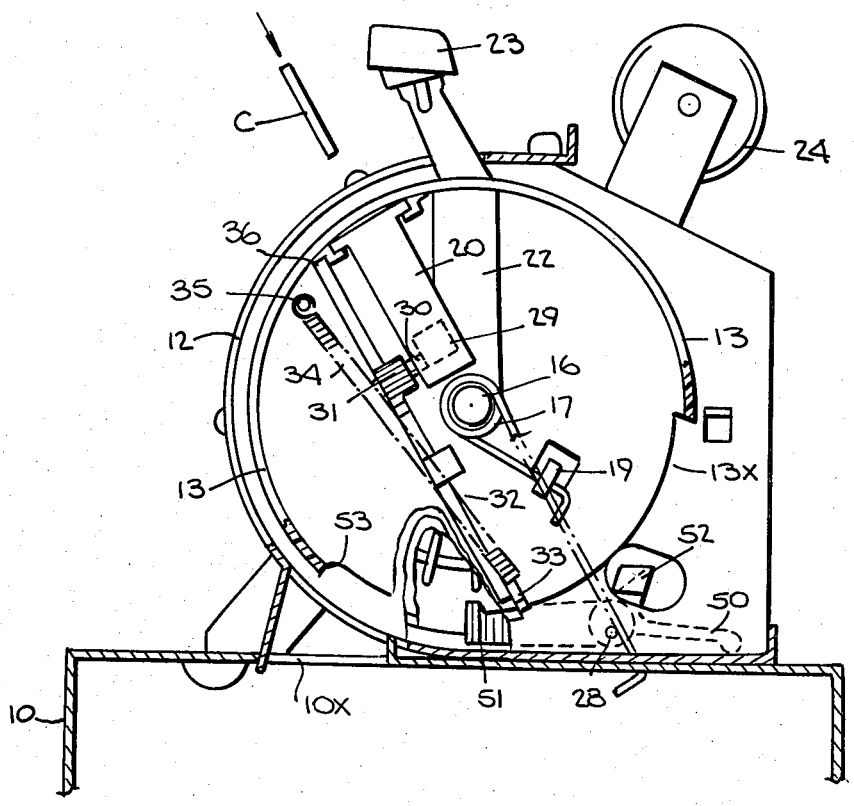
FIG. 3 is an end view of the toy bank looking into the drum when the drum occupies its normal angular positions at which it is receptive to a coin.
Figure 4:
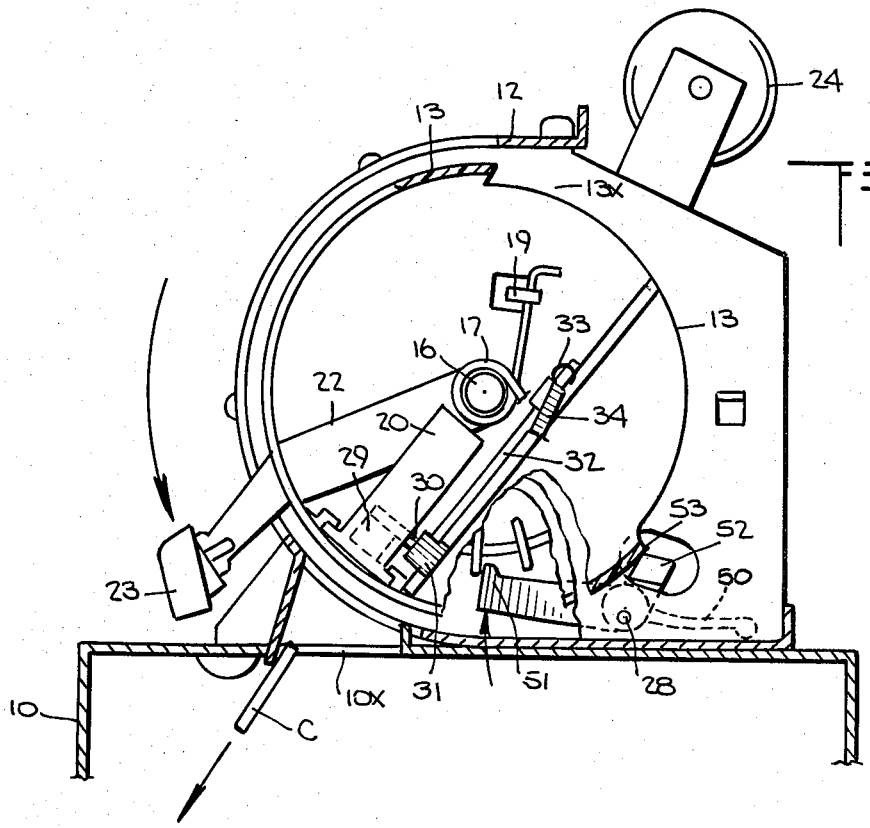
FIG. 4 is the same as FIG. 3, except that now the drum occupies its extreme angular position at which the received coin is dropped into a coin box.

Coin receiver 20, as best seen in FIGS. 3 and 4, has a coin collector 29 slidable therein which is linked by a transverse pin 30 extending through a longitudinal slot in the side of the receiver to the cam-actuator head 31 of a slider 32. The foot 33 of slider 32 is linked by a helical tension spring 34 to a post 35 adjacent the circular wall of drum 13. When the drum is at its normal position as shown in FIG. 3, the coin collector is at the bottom of receiver 20 in a position to collect an inserted coin of any size; and when the drum is at its extreme position, the collector goes to the top of the receiver to eject the coin into the box.

Cam-actuator head 31 projects through an elongated slot 36 in the side wall of drum 13 and, depending on its longitudinal position within this slot as determined by the size of the coin held in the coin receiver 20, selectively engages one of the arcuate cams 37, 38 and 39 (see FIGS. 5 and 6) formed on a clutch plate 40. Bell plate 24A, as will be seen in FIG. 7, is sandwiched between clutch plate 40 and drum 13 and is provided with openings to admit the cam actuator head 31 projecting through the side wall of the drum. Also pivotally mounted on shaft 28 is an interlock mechanism, generally designated by symbol IM, which will be later described in greater detail.

Clutch plate 40 is further provided with a resilient arcuate arm 41 defined by a cutout in this plate, arm 41 terminating in an offset finger 42 positioned to engage a circular series of teeth 43 on the side of the first wheel 14 which faces the clutch plate. When clutch plate 40 is turned in the counterclockwise direction, finger 42 acts to advance the first wheel in the same direction. Clutch plate 40 is turned clockwise when drum 13 reverts in the clockwise direction to its normal position; and when this occurs, finger 42 on resilient arm 41 runs over the teeth so that no clockwise movement of the first wheel is effected thereby.

Thus when a coin of a given size is deposited in the receiver and the drum is turned by the pull-down lever toward its extreme position, cam-actuator head 31 is caused to assume a position that depends on the size of the coin and to engage that cam on the clutch plate causing the plate to turn to an extent reflecting the size of the deposited coin. The first wheel is advanced concurrently to the same extent to register the deposit.

When drum 13 is released to return in the clockwise direction to its normal angular position, clutch plate 40 is also returned clockwise to its normal position as fixed by a tab 44 (see FIG. 2) attached to the periphery of the clutch plate which engages a stop 45 on the side of bell plate 24A. But clockwise movement of the clutch plate does not cause movement in the same direction as the first wheel which always advances in the counterclockwise direction to progressively register coin deposits.

Clapper arm 27 is provided, as shown in FIG. 7, by an actuator member 27A which engages the teeth 43 on the first wheel so that, as this wheel is turned, the clapper arm which is biased by a spring 46 (FIG. 2) oscillates about shaft 28 to ring the bell 24.

The first wheel 14 is intermittently coupled by a coupler gear 47 mounted on a shaft 48 (FIG. 2) to the second wheel 15 which is provided at one side with a circular series of teeth 49, the first and second wheels being intercoupled only when a tooth of the coupler gear 47 falls between a single pair of teeth (not shown) on the first wheel and a pair of teeth on the second wheel, thereby linking the wheels. This action occurs only once in each turn of the first wheel, so that when the first wheel makes a turn, the second wheel is advanced one step.

Since the bank illustrated herein is adapted to accept nickels, dimes and quarters, the scale on the first wheel is in five-point increments: a nickel causing the first wheel to advance one increment, a dime two increments, and a quarter five increments. A full turn of the first wheel is completed when a dollar in coins is deposited. The second wheel is in one-point increments, each representing a dollar, so that when the first wheel is advanced a full turn as a result of a deposit of a dollar in coins, the second wheel advances one increment to indicate the deposit of a dollar in coins.

Second wheel 15 is coupled to the latching mechanism (not shown) for the cash box door 11 and acts to release this latch only when the second wheel has made a full turn to indicate the deposit of $20, which represents the limit of its scale.

Interlock mechanism IM is provided with a spring 50 which acts to maintain the nose 51 of the mechanism in a retracted position relative to the teeth 43 of the first wheel. The mechanism further includes a finger 52 integral with the nose, the finger extending into an arcuate cutout 13X formed on the peripheral edge of drum 13, as best seen in FIGS. 3 and 4. The lower limit of this cutout constitutes an abutment 53 which strikes finger 52 of the interlock mechanism only when the drum approaches its extreme position, the abutment then causing the finger to swing the mechanism against the tension of spring 52 and thereby project nose 51 upwardly to engage a tooth on the series 43 to detent the first wheel.

Thus FIG. 3 shows finger 52 lying within the drum cutout, with nose 51 retracted. In FIG. 4, finger 52 is outside the cutout and nose 51 is then projected upwardly into the teeth of the first wheel.

Thus the three-coin register bank illustrated herein maintains an accurate count of the coins deposited therein, regardless of how vigorously the saver pulls down the drum lever; for the first wheel in the register, despite the momentum imparted to it by the drum, is arrested by the interlock mechanism when the drum reaches its extreme position whereby the first wheel always indicates the exact amount of the deposit and never overshoots to provide a false reading.

While there has been shown and described a preferred embodiment of a three-coin register toy bank in accordance with the invention, it will be appreciated that many changes and modifications may be made therein without, however, departing from the essential features thereof.

I claim:

1. A coin bank register bank adapted to accept and totalize coins of different size, said bank comprising:

A a cash box whose top wall is provided with an entry port;

B a hollow drum mounted for rotation above the box on an axle parallel to the top wall thereof, said drum having a coin receiver therein and being provided with a manually-operated pull-down lever for turning the drum from a normal angular position in which a coin may be deposited in the receiver, to an extreme angular position in which the receiver is aligned with the port to drop the coin in the cash box;

C a register wheel mounted on said axle and having a circular series of teeth thereon on the side thereof facing the drum;

D a clutch plate rotatably mounted on said axle between the drum and the first wheel, said plate being operatively coupled to the drum so that when the drum is turned to deposit a coin, the clutch plate is caused to turn in the same direction to an extent determined by the size of the coin and to engage the teeth of the first wheel, whereby the wheel is advanced concurrently therewith to indicate the deposit; and E an interlock mechanism triggered by the drum only when it is turned to its extreme position, the mechanism having a normally-retracted nose which, when the mechanism is triggered, is projected to engage said teeth and detent said first wheel to prevent any further advance thereof.

2. A bank as set forth in claim 1, wherein said interlock mechanism is provided with a pivotally-mounted finger that is integral with said nose, said finger being engaged by an abutment in said drum only when the drum occupies its extreme position to cause said finger to pivot and thereby project said nose.

3. A bank as set forth in claim 2, wherein said abutment is defined by a cutout on the peripheral edge of the drum.

4. A bank as set forth in claim 2, wherein said finger is spring-biased to normally hold said nose at its retracted position.

5. A bank as set forth in claim 1, further including a second register wheel mounted on said axle and means to intermittently couple said second wheel to said first wheel whereby said second wheel is advanced incrementally each time the first wheel makes a full turn.

6. A bank as set forth in claim 1, wherein said coins of different size are dimes, nickels and quarters.

7. A bank as set forth in claim 1, wherein said bank further includes a bell cooperating with a clapper having means to engage the teeth of the first wheel to ring said bell as the first wheel is turned.

8. A bank as set forth in claim 1, wherein said receiver is linked to a cam-actuator mounted on the end of a slider whose position is determined by the size of the coin in the receiver, said clutch plate having concentric cams thereon selectively engaged by the cam-actuator to turn said plate to an extent determined by the size of the coin.

9. A bank as set forth in claim 1, further including a helical spring wound about said axle within said drum to urge said drum to occupy its normal position.

* * * * *